US006384307B1

(12) United States Patent
Sueta, Jr. et al.

(10) Patent No.: US 6,384,307 B1
(45) Date of Patent: May 7, 2002

(54) HOLDER FOR WIND INSTRUMENT

(75) Inventors: Edward Sueta, Jr.; Julie M. Sueta, both of Bedminster, NJ (US)

(73) Assignee: Macie Publishing Company, Rockaway, NJ (US)

( * ) Notice: Subject to any disclaimer, the term of this patent is extended or adjusted under 35 U.S.C. 154(b) by 0 days.

(21) Appl. No.: 09/634,090

(22) Filed: Aug. 8, 2000

(51) Int. Cl.[7] ..... G10D 7/08
(52) U.S. Cl. ..... 84/385 A; 84/387 A
(58) Field of Search ..... 84/387 A, 385 A, 84/384, 379

(56) References Cited

U.S. PATENT DOCUMENTS 1,586,251 A * 5/1926 Lang ..... 84/385 A
3,266,766 A * 8/1966 Linville ..... 84/385 A
3,558,797 A * 1/1971 Wolford ..... 84/384

OTHER PUBLICATIONS

Wexler Complete Catalog of Musical Merchandise 1965/1966.*
C, Bruno and Sons 1834–1965.*
Catalog: "Music Is Elementary," cover and p. 4 (1998–1999).
Fall 1999 publication of The Orff Echo disclosing Bergerault's HALO product.

* cited by examiner

*Primary Examiner*—Robert E. Nappi
*Assistant Examiner*—Kim Lockett
(74) *Attorney, Agent, or Firm*—Lerner, David, Littenberg, Krumholz & Mentlik, LLP

(57) ABSTRACT

A device for holding a wind instrument comprises a flexible ring with at least a first configuration in a rest position and a second configuration in a stretched position. A strap may be provided to be worn around the neck of a user providing a way for suspending the associated wind instrument without the use of hands.

21 Claims, 3 Drawing Sheets

HOLDER FOR WIND INSTRUMENT

FIELD OF THE INVENTION

The present invention relates to holders for wind instruments. More specifically, the present invention relates to a device for holding a wind instrument around the neck of the player without the use of the player's hands.

BACKGROUND OF THE INVENTION

For players of musical instruments, there is a desire to support the instrument without the use of hands. This ability allows the player to easily turn a page of music or otherwise rest while not playing.

A recorder is a type of wind instrument made from various materials such as wood, plastic, and metal. It has a mouthpiece and an elongated body with air holes that are selectively covered by a player's fingers. Music is produced from a recorder by blowing air through the mouthpiece and adjusting the pitch by covering one or more of the air holes. Such configuration of recorders is well-known to those skilled in the art.

As recorders are often employed in the classroom setting for music education, it has become increasingly important to provide a hands-free support for those recorders. Such support is useful for children as it allows them to participate in exercises where hands are needed, such as rhythmic clapping exercises. One effective type of hands-free support is obtained through the use of a neck strap device that is secured to the recorder. Neck straps supports have advantages in that they are simple to use and are inexpensive products. However, various problems exist with prior art neck straps devices for recorders. One problem relates to the structure and operation of the prior art neck strap devices that affects they way that they are connected to the recorder. In particular, a rigid ring has been arranged on the strap. The ring is then placed over a portion of the recorder. While this arrangement is acceptable for certain types of recorders where the recorders have a configuration that accommodates placement within the ring, rigid rings are deficient in that they restrict the types of recorders that can be used with the holding strap device. Typically, rigid rings can only be used on the instrument they were designed for.

Another type of neck strap device comprises a continuous cord with a plastic cord lock. The user of this neck strap would place the cord around the body of the recorder and engage the cord lock to take up the slack until the cord was snug against the recorder. The other end of the loop would be worn around the neck. One problem with this device is that the cord lock does not sufficiently engage the recorder to prevent slippage.

Another problem with prior art neck strap devices including those discussed above is that the user, typically children, can hurt their neck if the strap gets caught on something or is purposely pulled.

Thus, there is a need for an improved neck strap holding device for wind instruments. The present invention addresses this need and the shortcomings of the prior art by providing an improved wind instrument support device.

SUMMARY OF THE INVENTION

In one preferred embodiment, the present invention comprises a flexible ring having at least a first configuration in a rest position and a second configuration in an extended position. The flexible ring is adapted to fit around a portion of a wind instrument. A strap is also connected to the flexible ring. The strap is sized and shaped to be worn around the neck of a user and allows the instrument to be suspended without the use of the user's hands. Preferably, the strap has a first end and a second end that are joined together to form a loop.

The ring is preferably sufficiently flexible so as to allow the user to stretch it from its rest configuration to an extended position whereby it can fit over a portion of the wind instrument. The ring can then be released and snugly secured at a portion of the instrument. This allows the flexible ring to be used with a variety of instruments of varying configuration (e.g., shape and dimension). The strap is preferably connected to the flexible ring, and may be placed around the player's neck allowing hands-free support of the instrument.

In one preferred embodiment, a breakaway portion may be provided to connect the first and second ends of the strap. The breakaway portion desirably includes a hook-and-loop type fastener where one part of the fastener is arranged at the first end of the strap and the other part of the fastener is arranged at the second end of the strap.

In the preferred embodiment that uses the breakaway safety feature, injuries are prevented to a user's neck that may be caused by the strap becoming inadvertently entangled or intentionally pulled. In this embodiment, the strap is designed to open when sufficient force is applied thereto.

The flexible ring is preferably made from a rubber compound. However, the ring may be made from other flexible materials such as, but not limited to, various polymeric materials other than rubber, nonwoven and woven natural and artificial fibers. The strap portion of the holder is desirably a flaccid cord, although other elongated materials may be used such as leather, polymeric materials, various natural and artificial fabrics, etc.

The above features and advantages of the present invention will be more fully understood with reference to the following written description when taken in conjunction with the accompanying drawings.

DETAILED DESCRIPTION OF THE PREFERRED EMBODIMENTS

Figure 1:
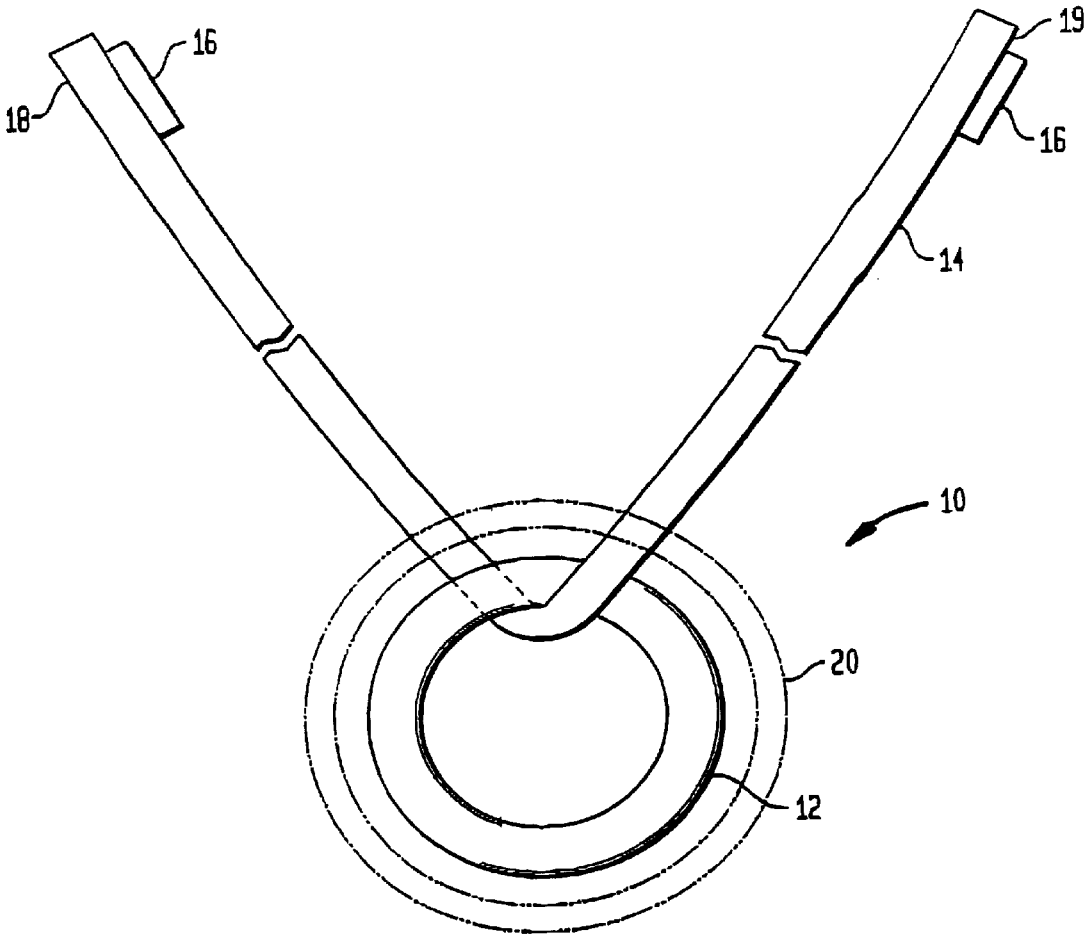
FIG. 1 is a partial front plan view of one embodiment of the present invention.

As shown in FIG. 1, the support device 10, according to one embodiment of the present invention comprises a flexible ring 12 and a strap 14. The flexible ring 12 is preferably made from a rubber compound, but other flexible materials can be used such as various polymeric materials, and nonwoven and woven natural and artificial fibers. As shown in FIG. 1, the flexible ring 12 may have a generally circular configuration. The flexible ring 12 is shown in its rest configuration, as depicted by solid lines D, and can be expanded to numerous configurations such as the enlarged diametric profile 20 as depicted by broken lines. In alternative embodiments, the flexible ring can have various geometric profiles in its rest position, and is not restricted to a circular profile. For example, the rest position for the flexible ring 12 may be an oval. As most wind instruments have a generally circular or oval profile, a complimentary profile for the flexible ring is most desirable as the ring will have a better fit around the instrument. The ring 12 can have varying rest dimensions which will depend on the general dimension of the instrument.

A strap 14 is also provided and is connected to the flexible ring 12. The strap is preferably made from a flaccid cord, however, other materials such as leather, polymeric materials or a fiber composition may be used. The strap 14 may be padded (not shown) to provide addition comfort from chaffing from prolonged use.

Figure 2:
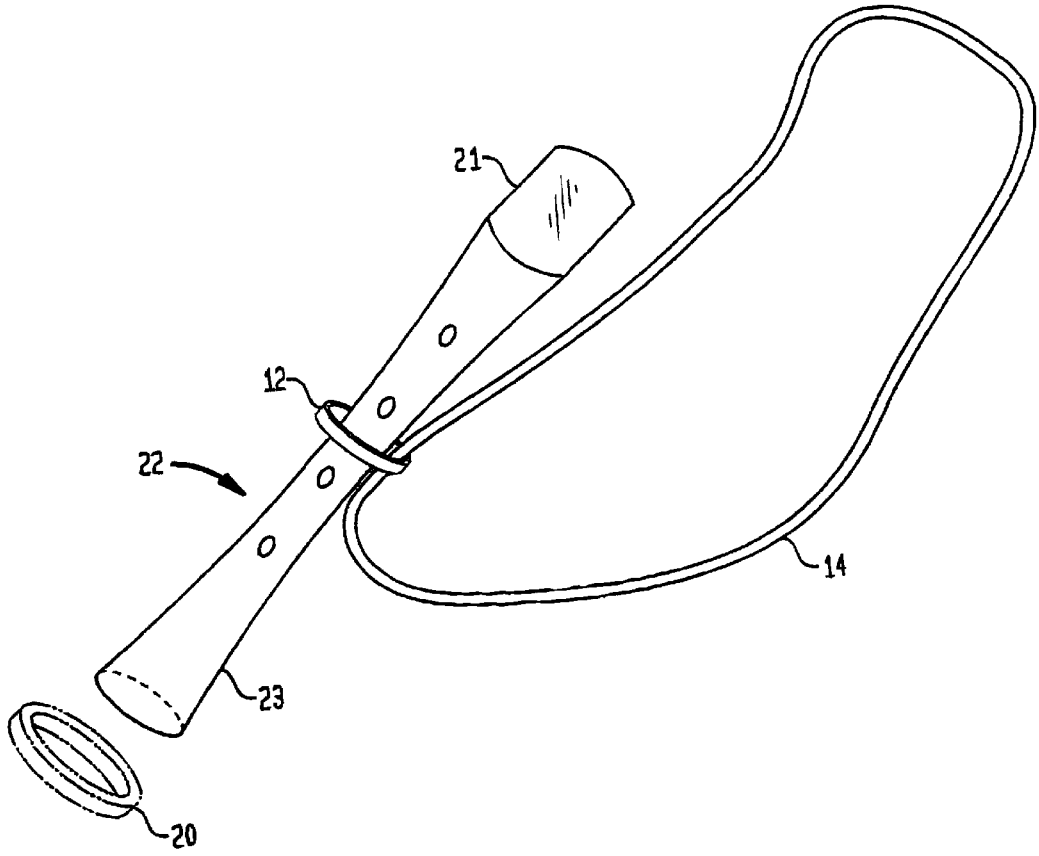
FIG. 2 is a perspective view of a supported wind instrument according to another embodiment of the present invention.

In the embodiment of FIG. 1, the strap 14 has two ends 18 and 19 that are connected to form a loop, as best shown in FIG. 1. For this embodiment, the two ends 18 and 19 of the strap can be tied together to form a loop to be worn around a user's neck. Preferably, the two ends 18 and 19 of the strap contain a breakaway portion 16. This breakaway portion 16 is a safety feature to prevent neck injury that could be caused by the strap 14 becoming caught on something or if the strap 14 is pulled while being worn. Preferably, the breakaway portion 16 comprises a hook and loop fastener where the hook portion is arranged at one of the two ends 18 or 19 of the strap and the loop portion is arranged at the other end 18 or 19 of the strap. Other types of breakaway portions may be used including but not limited to snap fit arrangements. Alternatively, the strap 14 can be a continuous loop, as shown in FIG. 2. In this embodiment, the strap is worn by the user by simply placing the strap over the head and around the neck.

Figure 3:
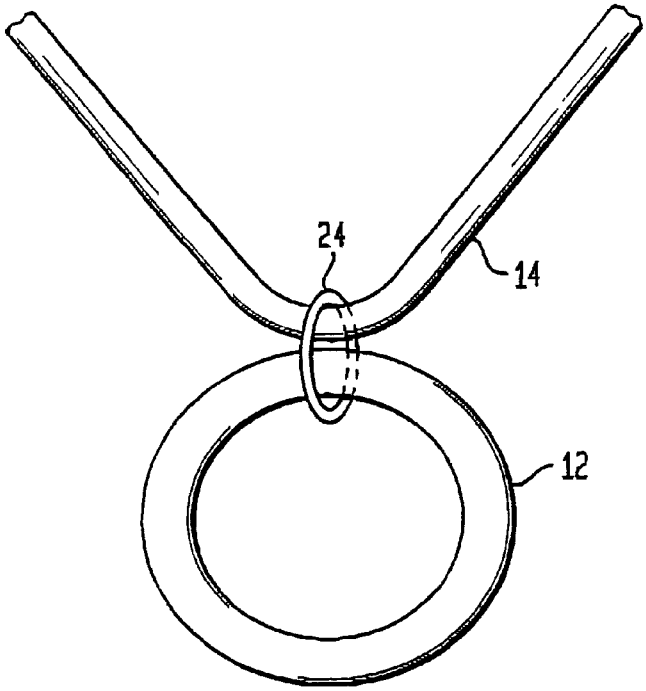
FIG. 3 is a partial front plan view of another embodiment of the present invention.
Figure 4:
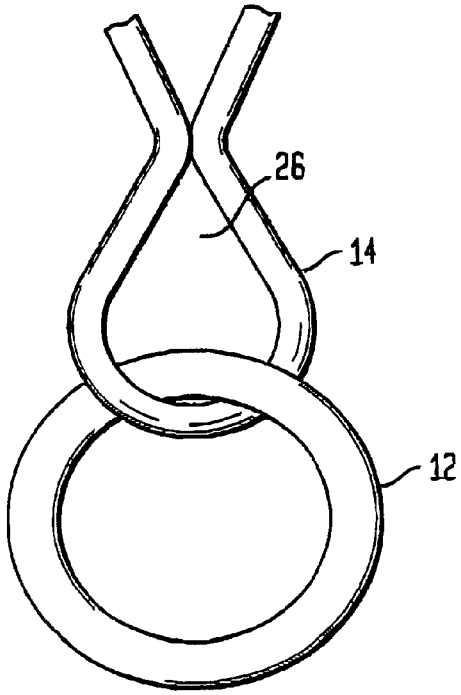
FIG. 4 is a partial front plan view of another embodiment of the present invention.

Another alternate embodiment is shown in FIG. 3 where the strap 14 is attached to the flexible ring 12 by a separate connector ring 24 or other clip. In this embodiment, the connector ring 24 secures the strap 14 to the flexible ring 12. In another embodiment, a portion of the strap 14 may form a connecting loop 26 as shown in FIG. 4. In this embodiment, two portions of the strap 14 are connected to form a connecting loop 26. The two portions may be sewn, stitched or glued together to form the connecting loop 26. Preferably, the size of the connecting loop 26 is relatively small in comparison to the size of the loop formed by connecting ends 18 and 19 that is worn around the user's neck. The connecting loop 26 ensures that the ring 12 will not slip off the strap 14 at one of the open ends 18 or 19 and prevents the ring 12 from sliding along the strap 14.

In use, the flexible ring 12 is stretched to an extended configuration 20 (see broken lines) so that it can be readily placed over a relatively large portion 23 of a wind instrument 22. As shown in FIG. 2, after the flexible ring is arranged on the associated wind instrument 22, its elastic nature will attempt to return it to its rest configuration. The flexible ring 12 will then be secured to a portion of the wind instrument 22. As noted above the flexible ring 12 can be stretched to any one of numerous possible extended configurations (e.g., second configuration 20). Thus, as shown in FIG. 2, the flexible ring 12 is attached to the recorder 22 after the ring 12 is stretched to pass over the enlarged bell portion 23 or the enlarged mouthpiece portion 21 of the recorder 22 and then relaxed to the original rest configuration.

The flexible ring 12 can also be used with wind instruments other than recorders, by varying the dimensions of the ring. Once the ring 12 is secured to the recorder 22, the strap 14 will retain the recorder 22 around a user's neck to allow hands-free support of the instrument. The flexibility of the ring 12, either alone or in combination with the breakaway aspect of the strap 14, makes the present invention especially useful in the classroom setting where children are learning to play recorders.

The flexible ring 12 provides an advantage over the rigid prior art rings in that the neck strap with the flexible ring can be used on different styles of recorders 22 with varying body profiles or on different types of wind instruments. Where a rigid ring could only be used in conjunction with a particular instrument it was designed for, the present invention allows many types of instruments to be held with a single strap and flexible ring.

The above description relates to preferred embodiments of the present invention and is not intended to be limiting of the scope of the present invention, which is defined by the claims as set forth below.

We claim:

1. A device for holding a wind instrument, comprising:

a stretchable ring having at least a first configuration in a rest position and a second configuration in an extended position, said stretchable ring adapted to be engaged around a portion of said wind instrument; and a strap connected to said stretchable ring, said strap having a size and structure to be worn around a neck of a user thereby supporting the wind instrument without the use of the user's hands.

2. The device of claim 1, wherein said strap has a first end and a second end.

3. The device of claim 2, wherein said strap comprises a breakaway portion where said first end and second end of said strap are removably connected to each other at said breakaway portion.

4. The device of claim 3, wherein said breakaway portion comprises a hook and loop fastener, said first end of said strap including one part of said hook and loop fastener and said second end of said strap including a second part of said hook and loop fastener.

5. The device of claim 1, wherein said stretchable ring comprises a polymeric material.

6. The device of claim 1, wherein said strap comprises a flexible cord.

7. The device of claim 1, wherein said strap comprises a continuous loop.

8. A supported wind instrument, comprising:

a wind instrument;

a stretchable ring having at least a first configuration in a rest position and a second configuration in an extended position, said stretchable ring adapted to be engaged around a portion of said wind instrument; and a strap connected to said stretchable ring, said strap having a size and structure to be worn around a neck of a user thereby supporting said wind instrument without the use of the user's hands.

9. The supported wind instrument of claim 8, wherein said strap has a first end and a second end.

10. The supported wind instrument of claim 9, wherein said strap comprises a breakaway portion where said first end and said second end of said strap are removably connected to each other at said breakaway portion.

11. The supported wind instrument of claim 10, wherein said breakaway link comprises a hook-and-loop fastener, said first end of said strap including one part of said hook and loop fastener and said second end of said strap including another part of said hook and loop fastener.

12. The supported wind instrument of claim 8, wherein said stretchable ring comprises a polymeric material.

13. The supported wind instrument of claim 8, wherein said strap comprises a flexible cord.

14. The supported wind instrument of claim 8, wherein said strap comprises a continuous loop.

15. The supported wind instrument of claim 8, wherein said instrument comprises a recorder.

16. A device for holding a wind instrument, comprising a strap having a size and structure to be worn around a neck of a user and operable to connect to a portion of said wind instrument, said strap including first and second ends and a breakaway portion such that said first end and said second end of said strap are removably connected to one another at said breakaway portion.

17. The device of claim 16, wherein said breakaway portion comprises a hook and loop fastener, said first end of said strap including one part of said hook and loop fastener and said second end of said strap including a second part of said hook and loop fastener.

18. The device of claim 16, wherein said strap comprises a flexible cord.

19. The device of claim 16, wherein said strap comprises a continuous loop.

20. The device of claim 1, further comprising a stretchable ring coupled to said strap and including at least a first configuration in a rest position and a second configuration in an extended position, said stretchable ring being adapted to engage around the portion of said wind instrument.

21. The device of claim 20, wherein said stretchable ring comprises a polymeric material.

* * * * *